United States Patent [19]

Sakamoto

[11] Patent Number: 4,879,699

[45] Date of Patent: Nov. 7, 1989

[54] AUDIO OUTPUT DEVICE

[75] Inventor: Yumi Sakamoto, Suwa, Japan

[73] Assignee: Seiko Epson Corporation, Tokyo, Japan

[21] Appl. No.: 248,524

[22] Filed: Sep. 23, 1988

[30] Foreign Application Priority Data

Sep. 25, 1987 [JP] Japan ..... 62-241118
Apr. 13, 1988 [JP] Japan ..... 63-90999

[51] Int. Cl.[4] ..... G04B 21/08; G04B 23/02

[52] U.S. Cl. ..... 368/63; 368/245; 368/251

[58] Field of Search ..... 368/10, 63, 72–75, 368/245, 250, 251

[56] References Cited

U.S. PATENT DOCUMENTS 4,386,856 6/1983 Hakata ..... 368/72
4,389,121 6/1983 Hashimoto et al. ..... 368/63

FOREIGN PATENT DOCUMENTS 57-59192 4/1982 Japan .
57-175282 10/1982 Japan .
2068602A 8/1981 United Kingdom .

*Primary Examiner*—Vit W. Miska
*Attorney, Agent, or Firm*—Blum Kaplan

[57] ABSTRACT

A timepiece includes an audio output device operable for announcing a plurality of different audio functions including stopwatch, timer, automatic time of day, alarm and user requested time of day. Selecting circuitry chooses among the group of audio functions based on a predetermined prioritized order. The device is operable for announcing one or more of the audio functions at different levels of sound volume.

63 Claims, 7 Drawing Sheets

AUDIO OUTPUT DEVICE

BACKGROUND OF THE INVENTION

This invention relates generally to a system for controlling the sound volume of an audio output device, and more particularly to a system for controlling the sound volume of an audio output device such as a timepiece based the audio function selected.

Audio output such as music, human voice, or the like can be permanently/fixedly or temporarily/variably stored in a magnetic or semi-conductor storage device of a timepiece. Conventional timepieces control the sound volume without regard to (i.e. independently of) the audio function selected. Audio functions include, but are not limited to, alarm, time of day, stop watch, and timer functions. Typically, the sound volume associated with these different audio functions is generated based on treating the audio functions as a single group regardless of the kind of timepiece used.

A timepiece such as disclosed in Japanese Patent Laid Open Application No. 57-175282 announces the beginning of each hour (e.g. 1:00, 2:00, etc.). Based on surrounding conditions and, in particular, based on brightness of the ambient light, the apparatus automatically varies the sound volume of the hourly message and alarm.

Another type of timepiece such as disclosed in Japanese Patent Laid Open Applicant No. 57-59192 includes a sleep mode during which time the sound volume is adjusted so that any periodic time of day announcements do not awake anyone who is near the timepiece. Thus, the sound volume is automatically reduced from the start of the "sleep" mode operation to either the start of alarm release operation or the release of "sleep" mode operation.

The foregoing conventional timepieces suffer from several drawbacks. Under the alarm mode the volume should be significantly louder than the volume for announcing the time of day when requested by an individual since a user in setting an alarm is not concerned with the present time of day but rather in being awakened or otherwise being made aware that a particular point in time has been reached. None of the conventional timepieces are designed to automatically generate sound volumes suitable for the typical ambient noise levels associated with each of the audio functions selected. When requesting the time of day, a user often is surrounded by relative silence and does not require or desire the announcement to be made at the high level of sound volume used for an alarm condition.

Conventional timepieces which announce the time of day at high levels of sound volume during an alarm mode do not allow the sound volume to be automatically varied between the alarm condition and a request for time of day (hereinafter referred to as "switch announcing"). In other words, the audio output is generated at the same sound volume regardless of the audio function selected. The timepiece when used for awakening an individual must be set at a high level of sound volume associated with the alarm condition to ensure that the user is awakened by the alarm. Once the user is awakened, however, the sound volume may need to be lowered if, for example, the switch audio announcing function is desired and the individual is surrounded by a low level of ambient noise (e.g. silence). Conventional timepieces therefore require adjustment by the user depending on the audio function selected to ensure that a suitable audio output is provided.

A user momentarily awakened during the middle of the night who wishes to determine the present time should be able to press a switch on the timepiece (i.e. switch announcing or user requested time of day), keeping his or her eyes closed, while listening to the time being announced. If the timepiece already has been set in an alarm mode, that is, at a high level of sound volume, the sound volume when announcing the present time will be at a totally unsuitable sound level which may awaken another individual proximate to the timepiece. The undesirable high level of sound volume also creates a degree of discomfort to the user although not at the same level of discomfort as would be created if the user had to open his or her eyes in determining the time of day.

Japanese Patent Laid Open Application Nos. 57-175282 and 57-591892 are designed to minimize the inconvenience and reduce the discomfort to a user who awakens in the middle of the night and wishes to determine the time of day. The timepiece disclosed in Application No. 57-175282 automatically reduces the volume at which it announces the time every hour on the hour when the ambient light level surrounding the timepiece is at a low level (i.e. dark). The timepiece disclosed in Application No. 57-59192 includes a "sleep" mode which when activated reduces the volume at which it announces the time every hour on the hour until the alarm goes off or the "sleep" mode ends. Neither of these Japanese Applications, however, allow a user the option to determine the time of day other than every hour on the hour.

Accordingly, it is desirable to provide a timepiece which allows a user to select from among a plurality of audio functions, each function being associated with a particular and suitable sound volume level.

SUMMARY OF THE INVENTION

Generally speaking, in accordance with the invention an audio output device includes a selector for selecting among a group of audio functions which includes user requested time of day, a synthesizer for producing audio data corresponding to the audio function selected, sound volume circuitry for producing a predetermined sound volume control signal corresponding to the audio function selected and audio output circuitry for producing an audio output based on the audio data and sound volume control signal.

The group of audio functions includes a time of day announced periodically (hereinafter referred to as "automatic speaking"), a time of day announced by user request (i.e. switch announcing), a stopwatch announcement, a timer announcement and a time of day announced as an alarm (hereinafter referred to as "alarm time"). The audio data for each of the audio functions is stored in storage circuitry which is supplied to the synthesizer based on the audio function chosen by the selector. The sound volume circuitry also includes a memory device for storing an appropriate sound volume setting for each of the audio output functions and control circuitry for producing the sound volume control signal based on the sound value setting corresponding to the selected audio function.

The audio output circuitry includes speaker driving circuitry to drive the speaker and additional control circuitry for controlling the current flow to the speaker based on the sound volume control signal produced by the sound volume circuitry.

Since the sound volume of each audio function is automatically preset at a level appropriate for the audio function selected, the undesirable high level of sound volume associated with alarm time is not imposed upon switch announcing. More particularly, the sound volume control signal associated with each audio function is automatically preset at a suitable level thereby avoiding announcements at the same sound volume as provided by conventional timepieces.

In one preferred embodiment of the invention a relatively high level of sound volume is automatically preset for announcing the time in connection with the audio functions of stopwatch, timer and automatic speaking. Therefore, an individual preoccupied with work, running or the like who is too absorbed to pay attention to or who is not near the timepiece will nevertheless be made aware of the announced audio function.

Further, by automatically presetting the sound volume level based on the audio function selected, a user who might otherwise tend to forget to change the sound volume from a low level to a high level will not miss an announcement as compared to conventional timepieces.

The invention also provides a user the freedom to vary the preset level of sound volume as desired. Therefore, the user is not bound by sound volume levels which are incompatible with the user's needs.

The invention also provides different weights of importance with each audio function. More particularly, the audio output associated with one function is generally of less importance to a user than the audio output associated with another function. Therefore, if two or more audio functions are ready to be announced at the same time, the selector will choose the more important function to announce first. For example, a timepiece places a higher level of priority to a stopwatch announcement than to automatic speaking. Consequently when both of these audio functions are ready to be announced at the same time, the stopwatch announcement is provided first. Therefore, a user will not erroneously mistake a time of day for the elapsed time of the stopwatch.

Accordingly, it is an object of the invention to provide an improved audio output device which provides a plurality of audio functions each of which is associated with a level of sound volume suitable for its intended use.

It is another object of the invention to provide an improved audio output device which includes a switch announcing function whose sound volume level is suitable for its intended use.

It is a further object of the invention to provide an improved audio output device in which the sound volume level associated with each audio function is automatically preset at a suitable level for its intended use.

It is still another object of the invention to provide an improved audio output device in which a plurality of audio functions have been prioritized in importance to avoid erroneously mistaking one function for another.

Still other objects and advantages of the invention will in part be obvious and will in part be apparent from the specification.

The invention accordingly comprises the several steps and a relation of one or more of such steps with respect to each of the others, and the apparatus embodying features of construction, a combination of elements and arrangements of parts which are adapted to effect such steps, all is exemplified in the following detailed disclosure, and the scope of the invention will be indicated in the claims.

BRIEF DESCRIPTIONS OF DRAWINGS

For a fuller understanding of the invention, reference is had to the following description taken in connection with the accompanied drawings, in which.

Figure 5A:
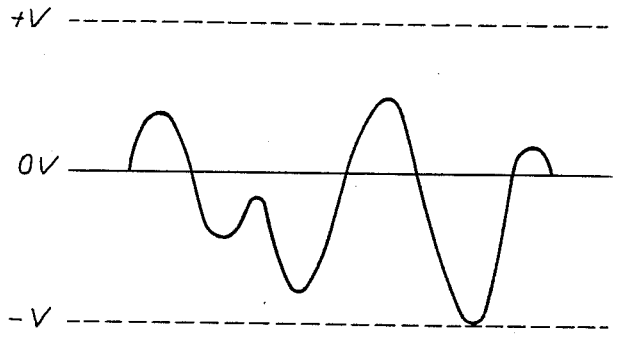
Figure 5B:
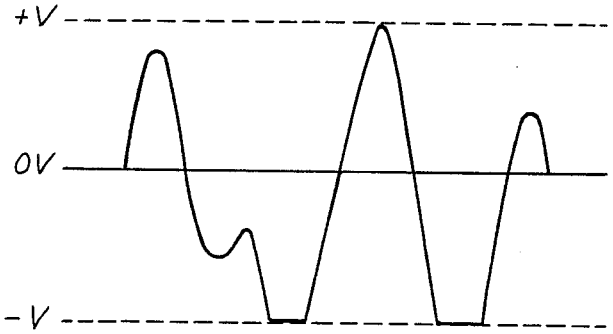
Figure 5C:
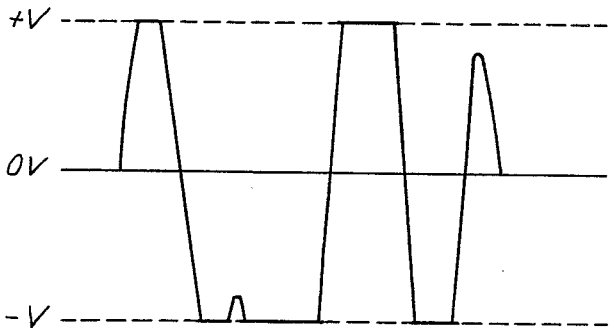
Figure 6:
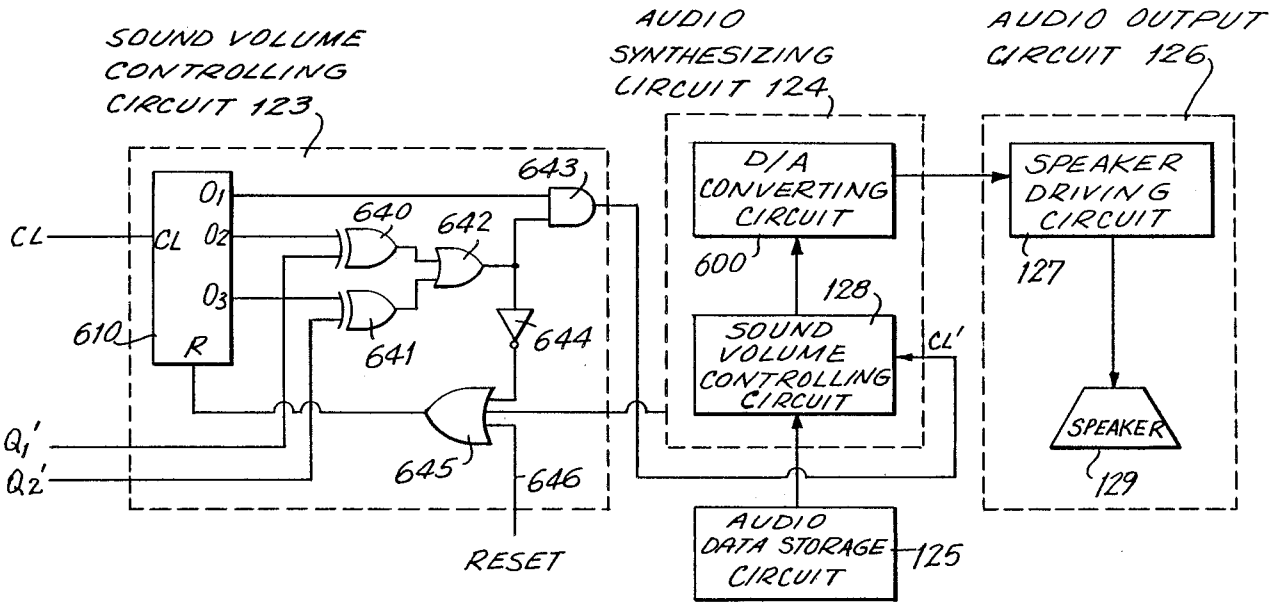
Figure 7:
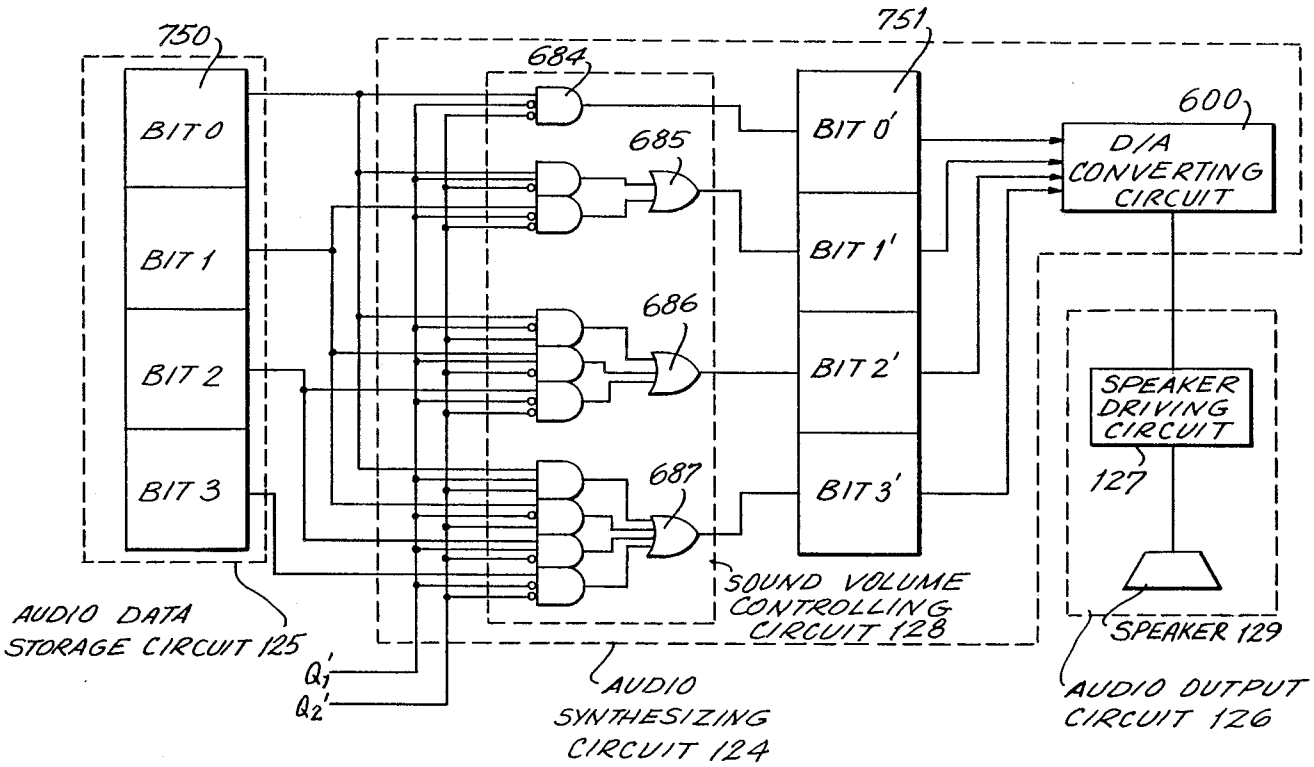

FIGS. 5(*a*), (*b*), (*c*) illustrate different sound volume waveforms produced by the device;

FIG. 6 is a block and circuit diagram of certain portions of the device in accordance with an alternative embodiment of the invention; and FIG. 7 is a block and circuit diagram of the certain portions of the device in accordance with yet another alternative embodiment of the invention.

DESCRIPTION OF THE PREFERRED EMBODIMENTS

Figure 1:
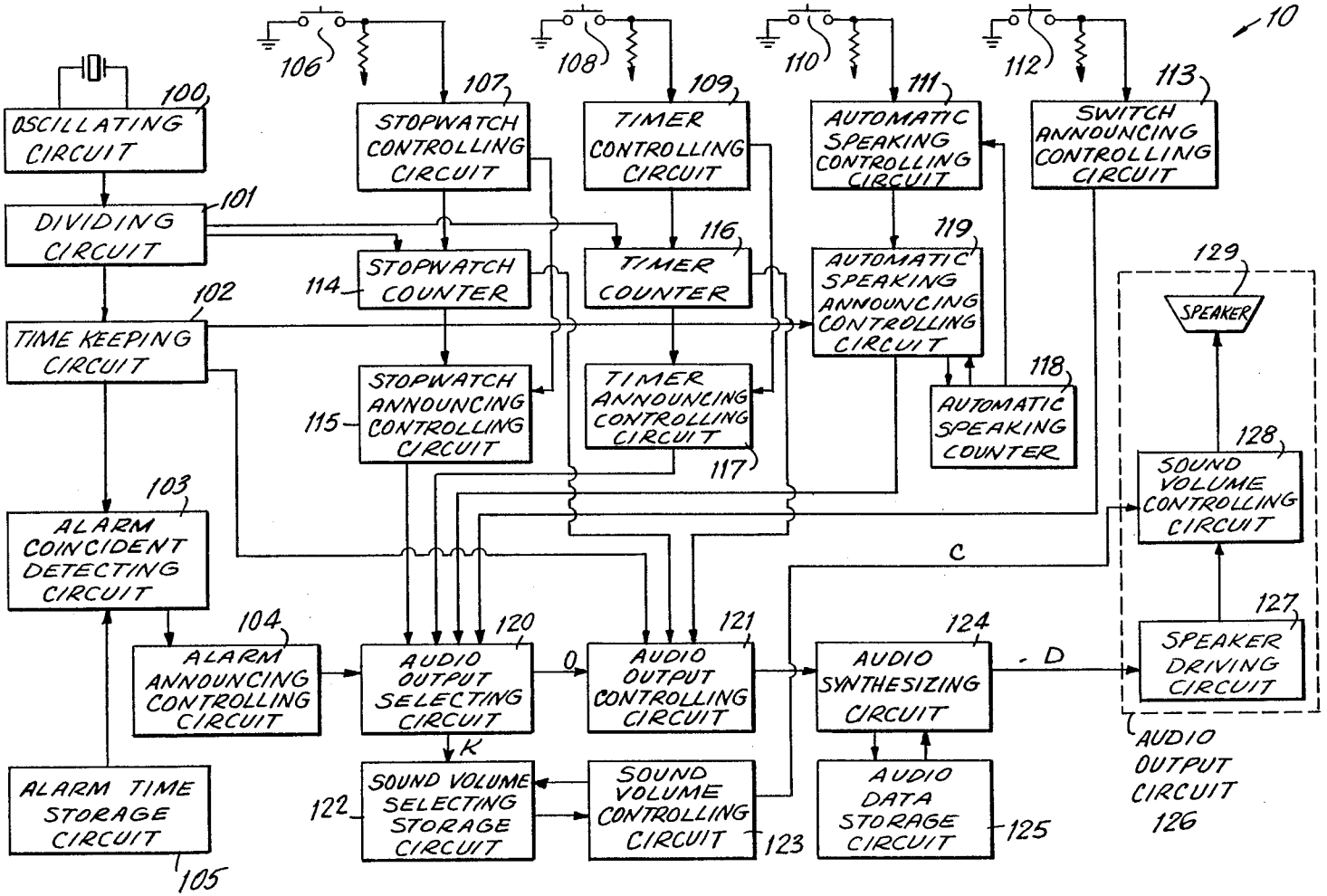
FIG. 1 is a block diagram of an audio output device in accordance with one embodiment of the invention.

For exemplary purposes only, as shown in FIG. 1 an audio output device 10 will hereinafter be described in connection with a timepiece.

Device 10 has five audio functions including alarm time switch announcing, stopwatch announcing, timer announcing and automatic speaking. The alarm time function, which is different from a normal alarm, generates an audio output at a high level of sound volume announcing the present time of day. The switch announcing function announces the present time by use of trigger as a switch input. The stopwatch function announces the elapsed time based on the value of a counter serving as a stop watch. The timer function announces the time based on the value of another counter serving as a timer. The automatic speaking function announces the present time each minute or every hour on the hour. The five functions are prioritized with the highest priority given to alarm time followed in descending order by the timer, stopwatch, switch announcing and the automatic speaking functions.

As shown in FIG. 1, a source frequency signal generated by an oscillating circuit 100 is supplied to a dividing circuit 101 which generates a reference clock signal supplied to a stopwatch counter 114, a timer counter 116 and a time keeping circuit 102. Time keeping circuit 102 maintains the present time by counting the number of pulses within the reference signal provided by dividing circuit 101.

The alarm time is set by an external switch (not shown) or the like and stored in an alarm time storage circuit 105. An alarm coincident detecting circuit 103 continuously or periodically compares the contents of time keeping circuit 102 (i.e., the present time) with the contents of alarm time storage circuit 105 (i.e., the alarm time). When the contents of circuits 102 and 105 are the same, alarm coincident signals are outputted from alarm coincident detecting circuit 103 and supplied to an alarm audio announcing controlling circuit 104.

When a user wishes to have device 10 announce the present time of day a time announcing switch 112 is pressed, activating a switch announcing controlling circuit 113. Switch announcing circuit 113 produces switch audio announcing output signals to audio output selecting circuit 120. Upon receiving the switch audio announcing output signals and assuming no signals associated with higher prioritized audio functions are received by circuit 120 at the same time, audio output selecting circuit 120 generates a pair of signals O and K representing the switch audio announcing function. Signal O is supplied to an audio output controlling circuit 121 which also receives the outputs from time keeping circuit 102. The outputs of stopwatch counter 114 and timer counter 116 are also connected to circuit 121. The signals supplied from time keeping circuit 102 are processed by audio output controlling circuit 121 to determine the present time. The output from audio output controlling circuit 121 (representative of current time) is supplied to an audio synthesizing circuit 124 which reads out the predetermined pattern of audio data corresponding to current time as stored in an audio data storage circuit 125. The selected digitized synthesized audio data is then converted by a digital to analog converter included within audio synthesizing circuit 124 to produce audio data signals D which are supplied to an audio output circuit 126. Included within audio output circuit 126 are a speaker driving circuit 127, another sound volume controlling circuit 128 and a speaker 129.

Signal K is produced simultaneously with output signal O by audio output selecting circuit 120 and supplied to a sound volume selecting storage circuit 122. Sound volume controlling circuit 123 receives an output signal from sound volume selecting storage circuit 122 based on signal K which corresponds to the audio function selected (e.g., switch announcing). The sound volume selecting storage circuit 122 stores a plurality of different sound volumes corresponding to the plurality of audio functions in for instance a random access memory (RAM). Sound volume selecting storage circuit 122 also includes switching which allows a user to vary the preset level of sound volume for each audio function at a level other than the level stored in the RAM. A more detailed explanation concerning sound volume selecting storage circuit 122 and/or sound volume controlling circuits 123 or 128 is described below in connection with FIGS. 2, 6 and 7.

Sound volume controlling circuit 123 produces a sound volume setting signal C which is supplied to sound volume controlling circuit 128. Speaker driver circuit 127 supplies a driving signal to sound volume controlling circuit 128 based on audio data signal D. Sound volume control circuit 128 adjusts the driving signal supplied by speaker driving circuit 127 based on sound volume setting (i.e. control) signal C. An audio output signal supplied to speaker 129 by speaker driving circuit 128 and adjusted by sound volume control circuit 128 represents the selected audio output function at a suitable level of sound volume.

The audio output signals corresponding to the alarm time function are produced by device 10 in a manner similar to the production of the audio output signals corresponding to the switch announcing function. More particularly, alarm audio announcing controlling circuit 104 upon receiving alarm coincident signals from alarm coincident detecting circuit 103 supplies an output signal to audio output selecting circuit 120. Audio output selecting circuit 120 upon receiving the output signal from alarm audio announcing controlling circuit 104 produces signals 0 and K corresponding to the alarm time function. The audio data provided to audio synthesizing circuit 124 from audio data storage circuit 125 represents a predetermined pattern of alarm data. The audio data from audio data storage circuit 125 is supplied to audio synthesizing circuit 124 based on the signals supplied to audio synthesizing circuit 124 from audio output controlling circuit 121. Audio output selecting circuit 120 produces signals O and K if device 10 is not currently producing audio output signals corresponding to some other audio output function (i.e., no requirement to produce audio output signals precedent to the signals from circuit 104 has been received by audio output selecting circuit 120 or the signals from circuit 104 are the first signals received by audio output selecting circuit 120).

Signal K which now represents the alarm time function is supplied to sound volume selecting storage circuit 122 from audio output selecting circuit 120. Sound volume selecting storage circuit 122 provides suitable sound volume data for an alarm condition to sound volume controlling circuit 123. Control signal C produced by sound volume controlling circuit 123, which now represents the sound volume level suitable for an alarm condition rather than for a time announcing function, is supplied to sound volume controlling circuit 128. Analog audio data signal D produced by audio synthesizing circuit 124 is supplied to speaker driving circuit 127 and represents the audio data for an alarm condition. If desired the sound volumes for both the alarm condition and switch announcing function can be adjusted to the same level by user.

The stopwatch and timer functions of device 10 are begun by turning on switches 106 and 108, respectively. Alternatively, the stop watch and timer functions are initiated once predetermined values are reached by stopwatch counter 114 and 116, respectively.

Stopwatch controlling circuit 107 and timer controlling circuit 109 control the start, end and time setting of the stop watch and timer functions and, in turn, are controlled by switches 106 and 108, respectively. Stopwatch counter 114 and timer counter 116 maintain a running count of the clock frequency produced by dividing circuit 101. When stopwatch counter 114 or timer counter 116 reaches a predetermined count value, an output signal is sent from stopwatch counter 114 or timer counter 116 to stopwatch announcing controlling circuit 115 or timer announcing controlling circuit 117, respectively. Output signals produced by stopwatch announcing controlling circuit 115 or timer announcing circuit 117 are supplied to audio output selecting circuit 120. Signals O and K corresponding to the selected audio function are then produced by audio output selecting circuit 120. The audio data pattern corresponding to the stopwatch function or the timer function is then supplied to audio synthesizing circuit 124 based on whether audio output selecting circuit 120 has selected the stopwatch or timer function. Similarly, control signal C corresponding to whether the stopwatch or timer functions has been selected as represented by signal K are produced by sound volume controlling circuit 123.

The automatic speaking function announces the present time of day periodically, for example, each minute and/or each hour. Preferably, the automatic speaking function announces the present time each minute. The automatic speaking function is activated by turning on switch 110. Time keeping circuit 102 provides an output signal to automatic speaking announcing controlling circuit 119 which passes the present time keeping information to an automatic speaking counter 118. When automatic speaking counter 118 reaches a predetermined count value, automatic speaking announcing controlling circuit 119 produces an output signal which is supplied to audio output selecting circuit 120. Audio output selecting circuit 120, audio output controlling circuit 121, sound volume selecting storage circuit 122, sound volume controlling circuit 123, audio synthesizing circuit 124, audio data storage circuit 125 and audio output circuit 126 operate in a manner similar to the operation of the switch audio function once the output signal from circuit 119 is received by audio output selecting circuit 120. The only difference in operation is that the sound volume and audio data is now based on the automatic speaking function rather than the switch announcing function.

By changing the predetermined count value of automatic speaking counter 118, the automatic speaking function can be changed from announcing the present time each minute to each hour or at some other suitable predetermined time interval.

Figure 2:
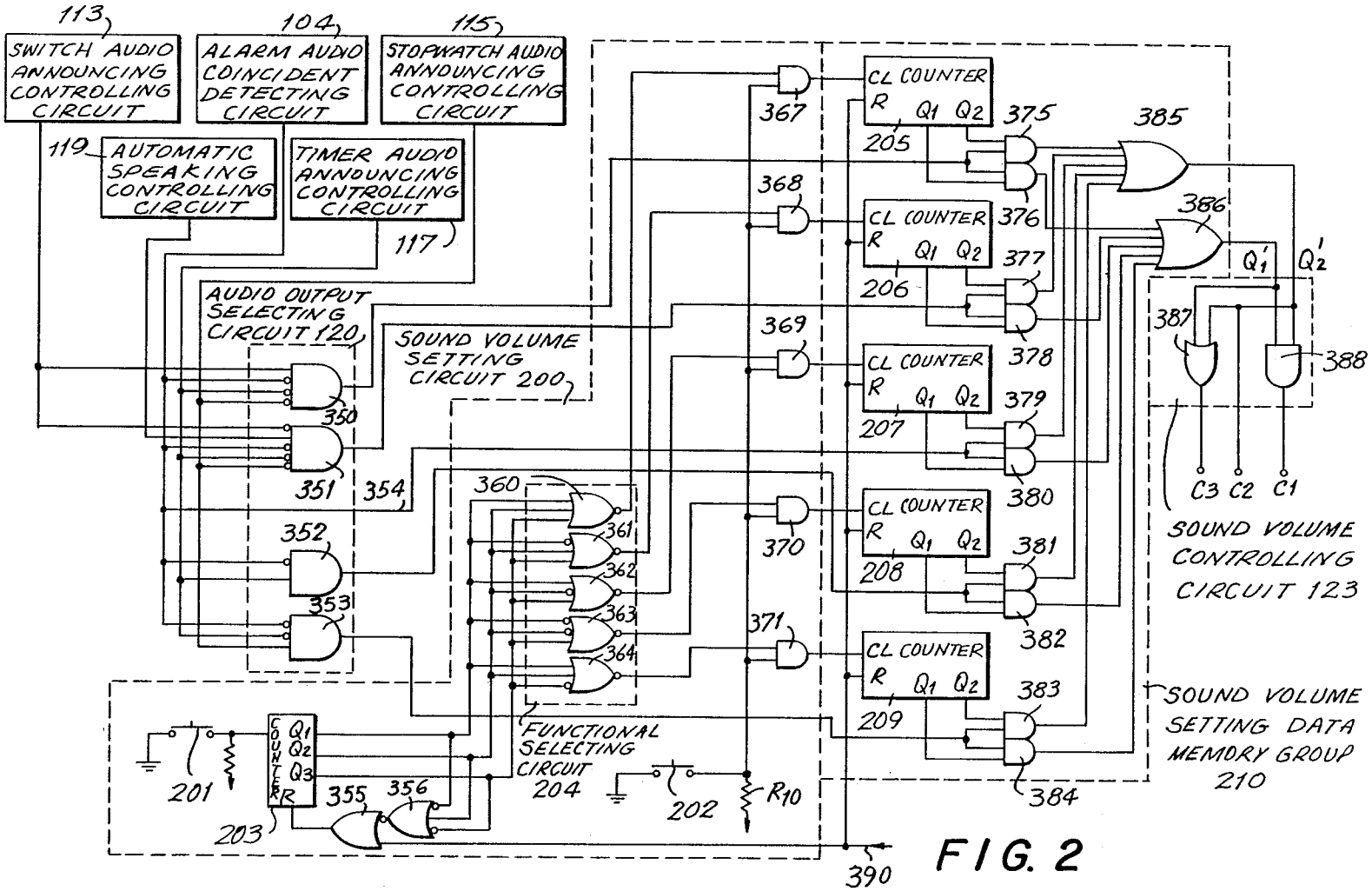
FIG. 2 is a block and circuit diagram of certain portions of the device.

FIG. 2 illustrates the method for controlling the sound volume level for each audio function. A sound volume data memory group 210 performs the same function as sound volume selecting storage circuit 122 of FIG. 1. Audio output selecting circuit 120 includes four AND gates 350, 351, 352, and 353 which are operable for receiving at least two of the output signals produced by circuits 104, 113, 115, 117 and 119 and a line 354 connected directly to circuit 104. AND gates 350, 351, 352 and 353 and line 354 prioritize these output signals so that audio output selecting circuit 120 chooses the most important of the available output signals based on a predetermined order. The order of priority of audio functions chosen by audio output selecting circuit 120 in descending order is alarm time, timer, stopwatch, switch audio and automatic speaking A sound volume setting circuit 200 includes a switch 201 which controls the number and timing of clock signals supplied to a counter 203 of circuit 200. A pair of OR gates 355 and 366 are used for resetting counter 203. Counter 203 includes three outputs $Q_1$, $Q_2$ and $Q_3$. Two inverting inputs of OR gate 356 are connected to outputs $Q_1$ and $Q_2$ of counter 203. A third noninverting input of OR gate 356 is connected to output $Q_2$ of counter 203. When outputs $Q_1$, $Q_2$ and $Q_3$ have logic levels of 1, 0, 1, respectively, counter 203 is reset. Counter 203 also can be reset by a reset signal supplied by an external reset line 390.

A functional selecting circuit 204 includes a plurality of NOR gates 360, 361, 362, 363 and 364, the inputs of which are connected to the outputs of counter 203. Counter 203 has five functions and is commonly referred to as a quinary counter. Each of the five outputs of functional selecting circuit 204 is connected to one of the inputs of one of AND gates 367–371. Based on the value of this quinary counter, functional selecting circuit 204 permits one and inhibits the other four of five AND gates 367, 368, 369, 370 and 371 to be turned on. The other input of each of these AND gates 367–371 is connected to a dc voltage source (not shown) through a resistor $R_{10}$. A switch 202 serves to vary the logic level applied to AND gates 367–371. Depending on the number of times that switch 202 is closed and opened and depending upon which of the AND gates 367–371 is provided with a high logic level from functional selecting circuit 204, one or more clock signals are supplied to and thereby increments one of five binary counters 205, 206, 207, 208 and 209 of sound volume setting data memory group 210. Specifically, the output of each of AND gates 367–371 is respectively coupled to the clock input of the corresponding counter 205–209.

Each of the five counters 205–209 can be reset through external line 390. Connected to a pair of outputs $Q_1$ and $Q_2$ of counters 205, 206, 207, 208 and 209 are pairs of AND gates 375 and 376, 377 and 378, 379 and 380, 381 and 382, and 383 and 384, respectively. Based on which of the pairs of AND gates 375–384 receives a high logic level signal (i.e. instructing signal) from audio output selecting circuit 120, the count value from one of the five counters 205–209 will pass through one of these pairs of AND gates to a pair of inputs of a pair of OR gates 385 and 386. OR gates 385 and 386 include a pair of outputs $Q'_1$ and $Q'_2$, respectively which are connected to sound volume controlling circuit 123.

Sound volume controlling circuit 123 includes one OR gate 387 and one AND gate 388 each having a pair of inputs connected to gates 387 and 388 of memory group 210. Circuit 123 also includes outputs $C_1$, $C_2$ and $C_3$ which produce control signal C. Outputs $C_1$ and $C_3$ are the outputs of gates 388 and 387, respectively. Output $C_2$ is connected directly to output $Q'_2$ of OR gate 385.

Counters 205–209 store four different values/states and are used for setting the sound volumes of the switch announcing, automatic speaking, alarm time, timer and stopwatch functions, respectively. With outputs $Q_1$, $Q_2$ and $Q_3$ of counter 203 all at a low logic level, outputs $Q'_1$ and $Q'_2$ reflect the count value of counter 205. More particularly, OR gate 360 of functional selecting circuit 204 provides a high logic level only to AND gate 367 Outputs $Q_1$, $Q_2$ of counter 205 can assume a pattern of low, low; high, low; low, high; and high, high logic levels based on switch 202 initially being closed and thereafter being opened one, two and three times, respectively. The pattern of logic levels for outputs $Q_1$ and $Q_2$ is repeated as switch 202 is closed and reopened thereafter. In other words, each time switch 202 is closed and opened, the sound volume setting corresponding to the count value of counter 205 is changed.

By changing the value of counter 203, that is, by closing and opening switch 201 once, outputs $Q_1$, $Q_2$ and $Q_3$ of counter 203 now assume high, low and low logic levels, respectively. A high logic level is provided as an input to AND gate 368 by OR gate 361 of functional selecting circuit 204. By closing and opening switch 201 once again, outputs $Q_1$, $Q_2$ and $Q_3$ of counter 203 now assume low, high and low logic levels, respectively. A high logic level is now provided to AND gate 369 by OR gate 362 of function selecting circuit 204. By closing and opening switch 201 yet another time, outputs $Q_1$, $Q_2$ and $Q_3$ of counter 203 now assume high, high and low logic levels, respectively, resulting in a high logic level being provided to AND gate 370 by OR gate 363 of functional selecting circuit 204. By closing and opening switch 201 yet one more time, outputs $Q_1$, $Q_2$ and $Q_3$ of counter 203 now assume low, low, and high logic levels, respectively, resulting in a high logic level being provided to AND gate 371 by OR gate 364 of functional selecting circuit 204.

As shown in FIG. 2 audio output selecting circuit 120 selects one of the five audio functions even when two or more audio functions are ready to be outputted at the same time based on the preassigned audio function priority discussed above. Signal C which is formed from outputs $C_1$, $C_2$ and $C_3$ represents the level of sound volume corresponding to the value of one of the five counters of group 210 chosen by audio output selecting circuit 120.

Figure 3:
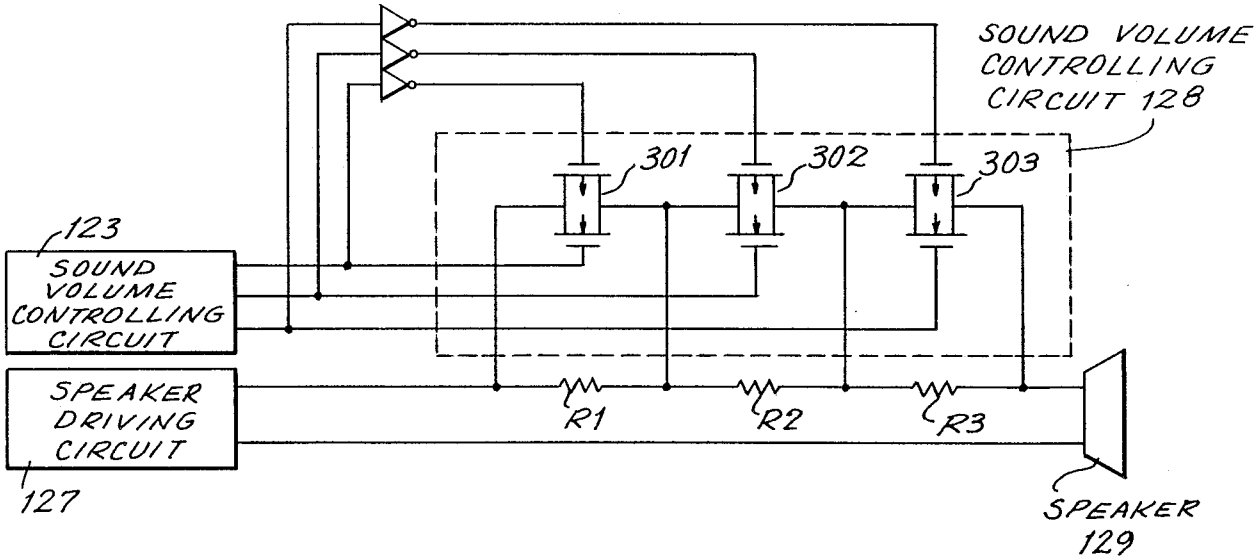
FIG. 3 is a block and circuit diagram illustrating a first embodiment of a sound volume controlling circuit.

As shown in FIG. 3, sound volume controlling circuit 128 adjusts the flow of current provided by speaker driving circuit 127 to speaker 129 based outputs $C_1$, $C_2$ and $C_3$ of sound volume controlling circuit 123. Sound volume controlling circuit 128 includes three transmission gates 301, 302 and 303. With transmission gates 301, 302 and 303 open due to outputs $C_1$, $C_2$ and $C_3$ being at low logic levels, current supplied from speaker driving circuit 127 will flow through three resistors $R_1$, $R_2$ and $R_3$. The sound volume is at a minimum level since the current flow is at a minimum. When outputs $C_1$, $C_2$ and $C_3$ are each at high logic levels, transmission gates 301, 302 and 303 are closed. Since transmission gates 301, 302 and 303 are electrically in parallel with resistors $R_1$, $R_2$ and $R_3$, respectively, the current produced by speaker driving circuit 127 flows through transmission gates 301, 302 and 303 rather than through resistors $R_1$, $R_2$ and $R_3$. A maximum level of current is now supplied to speaker 129 resulting in a maximum level of sound volume.

Figure 4:
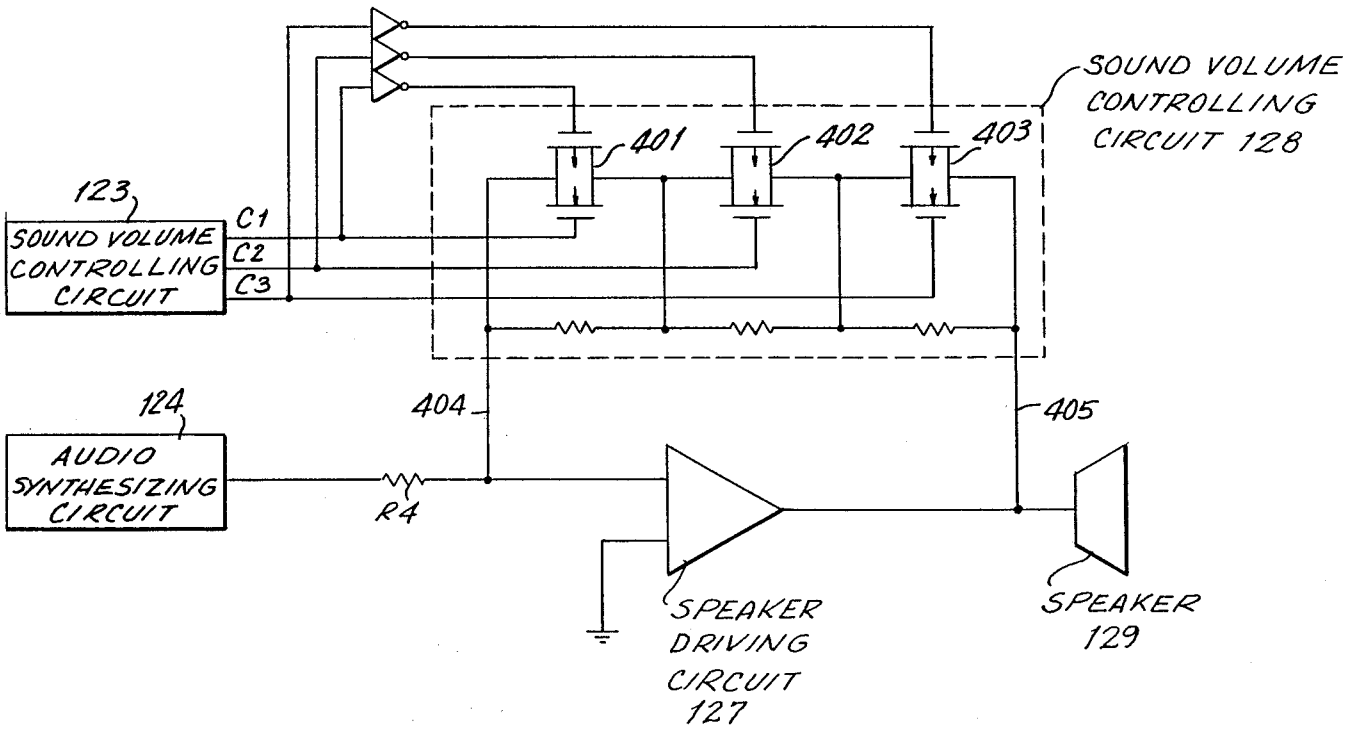
FIG. 4 is a block and circuit diagram illustrating a second embodiment of a sound volume controlling circuit.

FIG. 4 illustrates an alternative embodiment for controlling the sound volume of speaker 129. Sound volume controlling circuit 128 now includes transmission gates 401, 402 and 403 which are similar to and operate in the same manner as transmission gates 301, 302 and 303. Additionally, sound volume controlling circuit 128 also includes resistors $R_1$, $R_2$ and $R_3$ connected in parallel to transmission gates 401, 402 and 403, respectively. An operational amplifier serves as speaker driving circuit 127. Audio synthesizing circuit 124 through a resistor $R_4$ and an output lead 404 of sound volume controlling circuit 128 are connected to an inverting input of the operational amplifier. The noninverting input of the operational amplifier is grounded or connected to some other reference voltage level. The output of the operational amplifier and an external output lead 405 of sound volume controlling circuit 128 are connected to speaker 129. To change the sound volume of speaker 129, the feedback resistance, that is, the effective resistance across sound volume controlling circuit 128 (i.e., across leads 404 and 405) is varied based on the logic levels of outputs $C_1$, $C_2$ and $C_3$. With outputs $C_1$, $C_2$ and $C_3$ all at low logic levels, the resistance of sound volume controlling circuit 128 is represented by the resistances of resistors $R_1$, $R_2$ and $R_3$ summed together. Accordingly, the feedback resistance is minimal and the sound volume of speaker 129 is at a minimum. With outputs $C_1$, $C_2$ and $C_3$ at high logic levels, the resistance of sound volume controlling circuit 128 is substantially zero resulting in minimum feedback resistance. Consequently, speaker 129 is at a maximum level of sound volume.

Sound volume controlling circuit 128 in yet another alternative embodiment of the invention may be included within audio synthesizing circuit 124 rather than just before the speaker as shown in FIG. 4. For example, with audio data represented by four bits having a value of 0010, the sound volume is set at a minimum level as shown in FIG. 5 (*a*). When the audio data is shifted by one bit to the next superordination bit represented as 0100, the sound volume increases two-fold as shown in FIG. 5 (*b*). When the audio data is shifted once again to the next superordination bit represented as 1000, the sound volume increases four-fold as shown in FIG. 5 (*c*).

FIGS. 6 and 7 illustrate how sound volume controlling circuit 128 shifts the audio data by one or more superordination bits and thereby changes the sound volume as shown by the waveforms in FIG. 5 (*a*), (*b*) and (*c*). In FIG. 6 sound volume controlling circuit 128 is a shift register. Sound volume controlling circuit 123 includes a counter 610 having outputs $O_1$, $O_2$ and $O_3$ and two exclusive OR (XOR) gates 640 and 641. One input of each XOR gate 640 and 641 is connected to outputs $O_2$ and $O_3$ of counter 610, respectively. Circuit 123 also includes an OR gate 642. The inputs of OR gate 642 are connected to the outputs of XOR gates 640 and 641. The output of OR gate 642 is connected to one input of an AND gate 643 and to the input to an inverter 644. Another input of AND gate 643 is connected to output 01 of counter 610.

Circuit 123 also includes an OR gate 645 having three inputs, one input of which is connected to a reset line 646, a second input of which is connected to audio synthesizer circuit 124 and a third input of which is connected to the output of inverter 644. The output of OR gate 645 is connected to the reset input of counter 610. Outputs $Q'_1$ and $Q'_2$ of group 210 are connected to second inputs of XOR gates 640 and 641, respectively, rather than to gates 387 and 388 as shown in FIG. 2.

The output of sound volume controlling circuit 123 (i.e., the output of AND 643) provides a clock signal CL' to sound volume controlling circuit 128. The output from audio data storage circuit 125 is connected to the input of sound volume controlling circuit 128. Audio synthesizing circuit 124 includes sound volume controlling circuit 128 and a digital/analog converting circuit 600. The output of sound volume controlling circuit 128 is connected to the input of circuit 600. The output of circuit 600 is connected to speaker driving circuit 127. Speaker 129 and speaker driving circuit 127 form audio output circuit 126.

Prior to generating an audio output, counter 610 is reset (i.e. outputs $O_1$, $O_2$ and $O_3$ are at a logic level of O) by audio synthesizing circuit 124 or line 646 (which resets device 10) or when the logic levels of output $O_2$ of counter 610 and output $Q'_1$ of group 210 or output $O_3$ of counter 610 and output $Q'_2$ of group 210 are the same. When outputs $O_1$, $O_2$ and $O_3$ of counter 610 are at a low logic level and outputs $Q'_1$ and $Q'_2$ are also at a low logic level, clock signal CL' produced by sound volume controlling circuit 123 will be at a low logic level. Consequently, the sound volume level does not change and if already at the minimum sound volume level will have an audio output waveform as shown on FIG. 5 (*a*) If outputs $Q'_1$ and $Q'_2$ are at high and low logic levels, respectively, and one clock signal CL is received by counter 610, outputs $O_1$, $O_2$ and $O_3$ will have high, low and low logic levels, respectively. One pulse is produced by AND gate 643, that is, one clock signal CL' is inputted to sound volume controlling circuit 128. The sound volume data is shifted by one superordination bit. The audio output now has the waveform shown in FIG. 5(*b*). The next clock signal CL' will cause shift register 128 to shift by one additional superordination bit resulting in the waveform showing in FIG. 5 (*c*).

FIG. 7 illustrates a method for shifting the sound volume data based solely on changing the logic levels of outputs $Q'_1$ and $Q'_2$ when the sound volume data is transferred from sound volume storage circuit 125 to the memory of audio synthesizing circuit 124. Audio data storage circuit 125 includes a four bit (bit 0, bit 1, bit 2 and bit 3) memory 750. Bit 0 is considered the lowest subordination bit and bit 3 is the highest superordination bit. Audio synthesizing circuit 124 includes sound volume controlling circuit 128, a digital-to-analog converting circuit 600 and a four bit (bit 0', bit 1', bit 2' and bit 3') memory 751. Circuit 128 also includes logic circuitry including an AND gate 684, and three OR gates 685, 686 and 687. AND gate 684, OR gate 685, OR gate 686 and OR 687 supply shifted or unshifted audio data to bit 0', bit 1', bit 2' and bit 3' of memory 751, respectively.

When outputs $Q'_1$ and $Q'_2$ are both at low logic levels, the audio data stored in bit 0, bit 1, bit 2 and bit 3 of memory 750 is the same as the audio data stored bit 0', bit 1', bit 2' and bit 3' of memory 751, respectively. The original sound volume such as the waveform shown in FIG. 5 (*a*) remains the same. When outputs $Q'_1$ and $Q'_2$ are at high and low logic levels, respectively, the audio data stored in bit 1', bit 2'and bit 3' of memory 751 is the same as the audio data stored in bit 0, bit 1 and bit 2 of memory 750, respectively. The audio output now has the waveform shown in FIG. 5(*b*), that is, at a somewhat higher level of sound volume. With outputs $Q'_1$ and $Q'_2$ at low and high logic levels, respectively, the audio data stored in bit 2' and bit 3' of memory 751 is the same as the audio data stored in bit 0 and bit 1 of memory 750, respectively. The audio output waveform now appears as shown in FIG. 5 (*c*). That is, at fourfold the original sound volume level.

As shown in FIGS. 2, 6 and 7 the binary counters of sound volume setting data memory group 210 can be set for four different levels of sound volume, that is, outputs $Q'_1$ and $Q'_2$ can assume four different values. The sound volume is digitally changed by bit shifting in the random access memory shift register of sound volume controlling circuit 128. Sliding switches can be provided to set the sound volume for each audio announcing function. Switch 202 of sound volume setting circuit 200 can be controlled by a user to adjust the sound volume for each audio announcing function.

The invention also provides for fixed (preset) differences in sound volumes between the audio functions when the function is announced by device 10. Based on the number of times switch 202 is closed and opened, the different sound volume levels for each audio announcing function can be adjusted as desired.

Device 10 also provides an audio output for generating messages other than time announcing functions (not shown) which may be fixedly and permanently stored in device 10. Device 10 can also include recording functions so that a user can record messages.

Device 10 as described heretofore provides a plurality of audio functions which can be announced at different levels of sound volume. The structure of systems for announcing time and for recording and reproducing audio output for each of the audio functions are well known in the art and have therefore not been discussed herein.

As now can be readily appreciated, the invention provides an improved audio output device having a plurality of audio announcing functions such as an alarm time, switch announcing, timer, stopwatch and automatic speaking. The invention based on a prioritized order can select from among a plurality of different audio functions and provides sound volume control which automatically provides a suitable level of sound volume based on the selected audio function.

Device 10 provides an alarm time announcement which is generated at a suitably high level of sound volume to attract a user's attention who is unaware and/or not paying attention to the time. Device 10 also provides a switch announcing function employing a trigger as a switch input which can be generated at a much lower level of sound volume compared to the alarm time function. Advantageously, the reduced level in sound volume does not disturb others who may be in close proximity to device 10.

Each of the plurality of audio functions has their level of sound volume preset to a suitable level. The alarm time function is typically used for awakening an individual. Accordingly, the alarm time is announced at a high level of sound volume. When a user, however, in the middle of the night, who may, be in bed awakens and wishes to know the present time, the switch audio announcing output will be preset to a much lower level of sound volume. By being at a much lower level of sound volume, other people who may be in the room with the user will not be awakened. For alarm time, switch announcing, stopwatch, timer and automatic speaking functions, device 10 also allows a user to readjust the preset levels of sound volume. A user who may not be near device 10 can adjust the sound volume to a high level for the stopwatch, timer and automatic audio announcing functions.

When more than one audio function is to be announced in substantially the same time period, by adjusting the levels of sound volume between, for example, two different audio functions, a user can easily distinguish between the same. For example, stopwatch and automatic speaking functions can be set at high and low levels of sound volume, respectively, to prevent a user from erroneously mistaking the stopwatch function from the automatic speaking function.

It will thus be seen that the object set forth above, and those made apparent from the preceding description, are efficiently attained and, since certain changes may be made in the above method and construction set forth without departing from the spirit and scope of the invention, it is intended that all matter contained in the above description and shown in the accompanying drawings shall be interpreted as illustrative and not in a limiting sense.

It is also be to understood that the following claims are intended to cover all the generic and specific features of the invention herein described and all statements of the scope of the invention, which, as a matter of language, might be said to fall therebetween.

What is claimed is:

1. An audio output device, comprising:

selecting means for selecting among a group of audio functions including user requested time of day;

synthesizing means for producing audio data corresponding to the audio function selected;

sound volume means for producing a predetermined sound volume control signal corresponding to the audio function selected; and audio output means for producing an audio output at a predetermined level of sound volume based on the audio data and sound volume control signal.

2. The audio output device of claim 1;, wherein said selecting means includes logic means for selecting among the group of audio functions based on a predetermined order of priority.

3. The audio output device of claim 1, wherein the synthesizing means includes audio data storage means for storing predetermined patterns of audio data for the audio functions.

4. The audio output device of claim 2, wherein the synthesizing means includes audio data storage means for storing predetermined patterns of audio data for the audio functions.

5. The audio output device of claim 1, wherein the sound volume means includes memory means for storing a plurality of predetermined settings, one of said predetermined settings corresponding to the sound volume level of the audio output.

6. The audio output device of claim 5, wherein the memory means includes a plurality of counters for storing the predetermined settings, each counter corresponding to one of the group of audio functions.

7. The audio output device of claim 6, wherein the sound volume means further includes setting means for permitting one of said counters to be incremented in its predetermined setting and inhibiting the remaining counters from being incremented in their predetermined settings.

8. The audio output device of claim 7, wherein the setting means further includes functional selecting means for determining which one of said plurality of counters can be incremented.

9. The audio output device of claim 5, wherein the sound volume means includes control means for producing the predetermined control signal based on one of said predetermined settings.

10. The audio output device of claim 7, wherein the sound volume means includes control means for producing the predetermined control signal based on one of said predetermined settings.

11. The audio output device of claim 9, wherein the selecting means produces an instructing signal representing the audio function selected and the memory means includes logic means for controlling which of the predetermined settings is supplied to the control means based on the instructing signal.

12. The audio output device of claim 10, wherein the selecting means produces an instructing signal representing the audio function selected and the memory means includes logic means for controlling which of the predetermined settings is supplied to the control means based on the instructing signal.

13. The audio output apparatus of claim 5, wherein the setting means further includes clock generating means for generating clock signals wherein the predetermined settings of said memory means are based on the number of clock signals generated.

14. The audio output apparatus of claim 9, wherein the setting means further includes clock generating means for generating clock signals wherein the predetermined settings of said memory means are based on said clock signals.

15. The audio output apparatus of claim 10, wherein the setting means further includes clock generating means for generating clock signals wherein the predetermined settings of said memory means are based on said clock signals.

16. The audio output apparatus of claim 5, wherein the audio output means includes additional sound volume means, speaker driving means and speaker means, said speaker driving means providing current to drive said speaker means for generating the audio output and wherein the additional sound volume means is operable for adjusting the current flowing to said speaker means in response to the sound volume control signal.

17. The audio output apparatus of claim 16, wherein the speaker driving means and speaker means are connected to each other through a plurality of resistors connected electrically in series and wherein the additional sound volume means is connected electrically in parallel with the plurality of resistors.

18. The audio output apparatus of claim 17, wherein the speaker driving means includes an operational amplifier and wherein the additional sound volume means serves as a feedback loop for the operational amplifier.

19. The audio output apparatus of claim 8, wherein the audio output means includes additional sound volume means, speaker driving means and speaker means, said speaker driving means providing current to drive said speaker means for generating the audio output and wherein the additional sound volume means is operable for adjusting the current flowing to said speaker means in response to the sound volume control signal.

20. The audio output apparatus of claim 19, wherein the speaker driving means and speaker means are connected to each other through a plurality of resistors connected electrically in series and wherein the additional sound volume means is connected electrically in parallel with the plurality of resistors.

21. The audio output apparatus of claim 20, wherein the speaker driving means includes an operational amplifier and wherein the additional sound volume means serves as a feedback loop for the operation amplifier.

22. The audio output apparatus of claim 11, wherein the audio output means includes additional sound volume means, speaker driving means and speaker means, said speaker driving means providing current to drive said speaker means for generating the audio output and wherein the additional sound volume means is operable for adjusting the current flowing to said speaker means in response to the sound volume control signal.

23. The audio output apparatus of claim 22, wherein the speaker driving means and speaker means are connected to each other through a plurality of resistors connected electrically in series and wherein the additional sound volume means is connected electrically in parallel with the plurality of resistors.

24. The audio output apparatus of claim 23, wherein the speaker driving means includes an operational amplifier and wherein the additional sound volume means serves as a feedback loop for the operational amplifier.

25. The audio output apparatus of claim 1, wherein the synthesizing means includes digital to analog converter means for converting the audio data from a digital to analog signal and shift register means for shifting the audio data in its digital form by at least one superordination bit.

26. The audio output apparatus of claim 5, wherein the synthesizing means includes digital to analog converter means for converting the audio data from a digital to analog signal and shift register means for shifting the audio data in its digital form by at least one superordination bit.

27. The audio output apparatus of claim 8, wherein the synthesizing means includes digital to analog converter means for converting the audio data from a digital to analog signal and shift register means for shifting the audio data in its digital form by at least one superordination bit.

28. The audio output apparatus of claim 11, wherein the synthesizing means includes digital to analog converter means for converting the audio data from a digital to analog signal and shift register means for shifting the audio data in its digital form by at least one superordination bit.

29. The audio output device of claim 4, wherein the sound volume means includes memory means for storing a plurality of predetermined settings, one of said predetermined settings corresponding to the sound volume level of the audio output.

30. The audio output device of claim 29, wherein the memory means includes a plurality of counters for storing the predetermined settings, each counter corresponding to one of the group of audio functions.

31. The audio output device of claim 30, wherein the sound volume means further includes setting means for permitting one of said counters to be incremented in its predetermined setting and inhibiting the remaining counters from being incremented in their predetermined settings.

32. The audio output device of claim 31, wherein the setting means further includes functional selecting means for determining which one of said plurality of counters can be incremented.

33. The audio output device of claim 29, wherein the sound volume means includes control means for producing the predetermined control signal based on one of said predetermined settings.

34. The audio output device of claim 31, wherein the sound volume means includes control means for producing the predetermined signal based on one of said predetermined settings.

35. The audio output device of claim 33, wherein the selecting means produces an instructing signal representing the audio function selected and the memory means includes logic means for controlling which of the predetermined settings is supplied to the control means based on the instructing signal.

36. The audio output device of claim 34, wherein the selecting means produces an instructing signal representing the audio function selected and the memory means includes logic means for controlling which of the predetermined settings is supplied to the control means based on the instructing signal.

37. The audio output apparatus of claim 29, wherein the setting means further includes clock generating means for generating clock signals wherein the predetermined settings of said memory means are based on the number of clock signals generated.

38. The audio output apparatus of claim 34, wherein the setting means further includes clock generating means for generating clock signals wherein the predetermined settings of said memory means are based on said clock signals.

39. The audio output apparatus of claim 34, wherein the setting means further includes clock generating means for generating clock signals wherein the predetermined settings of said memory means are based on said clock signals.

40. The audio output apparatus of claim 32, wherein the audio output means includes additional sound volume means, speaker driving means and speaker means, said speaker driving means providing current to drive said speaker means for generating the audio output and wherein the additional sound volume means is operable for adjusting the current flowing to said speaker means in response to the sound volume control signal.

41. The audio output apparatus of claim 40, wherein the speaker driving means and speaker means are connected to each other through a plurality of resistors connected electrically in series and wherein the additional sound volume means is connected electrically in parallel with the plurality of resistors.

42. The audio output apparatus of claim 41, wherein the speaker driving means includes an operational amplifier and wherein the additional sound volume means serves as a feedback loop for the operational amplifier.

43. The audio output apparatus of claim 36, wherein the audio output means includes additional sound volume means, speaker driving means and speaker means, said speaker driving means providing current to drive said speaker means for generating the audio output and wherein the additional sound volume means is operable for adjusting the current flowing to said speaker means in response to the sound volume control signal.

44. The audio output apparatus of claim 43, wherein the speaker driving means and speaker means are connected to each other through a plurality of resistors connected electrically in series and wherein the additional sound volume means is connected electrically in parallel with the plurality of resistors.

45. The audio output apparatus of claim 44, wherein the speaker driving means includes an operational amplifier and wherein the additional sound volume means serves as a feedback loop for the operational amplifier.

46. The audio output apparatus of claim 5, wherein the synthesizing means includes digital to analog converter means for converting the audio data from a digital to analog signal and shift register means for shifting the audio data in its digital form by at least one superordination bit.

47. The audio output apparatus of claim 32, wherein the synthesizing means includes digital to analog converter means for converting the audio data from a digital to analog signal and shift register means for shifting the audio data in its digital form by at least one superordination bit.

48. The audio output apparatus of claim 35, wherein the synthesizing means includes digital to analog converter means for converting the audio data from a digital to analog signal and shift register means for shifting the audio data in its digital form by at least one superordination bit.

49. The audio output device of claim 1, wherein the sound volume means includes means for adjusting the sound volume control signal whereby the predetermined level of sound volume of the audio output is correspondingly adjusted.

50. The audio output device of claim 5, wherein the sound volume means includes means for adjusting the sound volume control signal whereby the predetermined level of sound volume of the audio output is correspondingly adjusted.

51. The audio output device of claim 8, wherein the sound volume means includes means for adjusting the sound volume control signal whereby the predetermined level of sound volume of the audio output is correspondingly adjusted.

52. The audio output device of claim 11, wherein the sound volume means includes means for adjusting the sound volume control signal whereby the predetermined level of sound volume of the audio output is correspondingly adjusted

53. An audio output device, comprising:

selecting means for selecting one of at least two audio announcing functions and producing a first signal and a second signal based on the selected functions, said two audio functions selected from the group of functions consisting of a user request time of day function, an alarm announcing function, a stopwatch audio announcing function, a timer audio announcing function and an automatic speaking announcing function;

synthesizing means for producing an audio output signal based on the first signal and corresponding to the selected function;

sound volume storage means for storing sound volume data associated with each of the functions;

sound volume control means for adjusting the sound volume data from the sound volume storage means in response to the second signal whereby the adjusted sound volume data corresponds to the selected function and producing sound volume setting signals; and audio output means for producing an audio output based on the audio output signal and the sound volume setting signals whereby the audio output is at a predetermined sound volume.

54. The audio output device of claim 53, wherein the sound volume means includes means for adjusting the sound volume setting signals whereby the predetermined level of sound volume of the audio output is correspondingly adjusted.

55. The audio output device of claim 52, wherein said at least two audio announcing functions includes a user requested time of day function.

56. The audio output apparatus of claim 52, wherein the audio output means includes additional sound volume control means, driver means and speaker means, the driving means providing current to the speaker means to drive the speaker means for generating the audio output and wherein the additional sound volume means is operable for adjusting the current flowing to the speaker means in response to the sound volume setting signals.

57. The audio output device of claim 52, wherein the synthesizing means includes shift register means operable for shifting the audio output signal prior to being produced by the synthesizing means by at least one superordination bit in response to the sound volume setting signals.

58. The audio output device of claim 52, wherein the sound volume data associated with at least two functions correspond to different levels of sound volume.

59. The audio output device of claim 53, wherein the audio output means includes additional sound volume control means, driver means and speaker means, the driving means providing current to the speaker means to drive the speaker means for generating the audio output and wherein the additional sound volume means is operable for adjusting the current flowing to the speaker means in response to the sound volume setting signals.

60. The audio output device of claim 53, wherein the synthesizing means includes shift register means operable for shifting the audio output signal prior to being produced by the synthesizing means by at least one superordination bit in response to the sound volume setting signals.

61. The audio output device of claim 53, wherein the sound volume data associated with at least two functions correspond to different levels of sound volume.

62. An audio output device, comprising:

selecting means for selecting among a group of audio functions including user requested time of day, for producing an instructing signal and including logic means for selecting among the group of audio functions based on a predetermined order of priority;

synthesizing means for producing audio data corresponding to the audio function selected and including audio data storage means for storing a predetermined pattern of audio data for each of the audio functions;

sound volume means for producing a predetermined sound volume control signal corresponding to the audio function selected and including a plurality of counters for storing a plurality of predetermined settings, each counter corresponding to one of the group of audio functions: setting means for permitting one of said counters to be incremented in its predetermined setting, for inhibiting the remaining counters from being incremented in their predetermined settings and including functional selecting means for determining which one of said plurality of counters can be incremented; and clock generating means for producing clock signals wherein the predetermined settings of the counters are based on the clock signals; and audio output means for producing an audio output at a predetermined level of sound volume based on the audio data and sound volume control signal and including additional sound volume means, speaker driving means and speaker means, the speaker driving means operable for providing current to drive the speaker means for generating the audio output and the additional sound volume means operable for adjusting the current flowing to the speaker means in response to the control signal.

63. A method for generating an audio output at a predetermined level of sound volume, comprising:

selecting among a group of audio functions which includes user requested time of day;

storing audio data corresponding to the group of audio functions;

selecting the stored audio data corresponding to the selected audio output function;

storing a plurality of predetermined sound volume settings, each sound volume setting associated with one of the group of audio functions;

selecting one of the sound volume settings based on the selected audio function; and producing an audio output based on the selected audio data and selected sound volume setting.

* * * * *